US009725230B2

(12) United States Patent
Huang

(10) Patent No.: US 9,725,230 B2
(45) Date of Patent: Aug. 8, 2017

(54) PACKAGING BOX FOR ELECTRONIC DEVICE

(71) Applicant: FIH (HONG KONG) LIMITED, Kowloon (HK)

(72) Inventor: Chiu-Chu Huang, New Taipei (TW)

(73) Assignee: FIH (HONG KONG) LIMITED, Kowloon (HK)

( * ) Notice: Subject to any disclaimer, the term of this patent is extended or adjusted under 35 U.S.C. 154(b) by 20 days.

(21) Appl. No.: 14/678,446

(22) Filed: Apr. 3, 2015

(65) Prior Publication Data

US 2016/0114965 A1 Apr. 28, 2016

(30) Foreign Application Priority Data

Oct. 27, 2014 (TW) ..... 103137095 A

(51) Int. Cl.

| | |
|---|---|
| ***B65D 85/00*** | (2006.01) |
| ***B65D 85/30*** | (2006.01) |
| ***B65D 59/04*** | (2006.01) |
| ***B65D 73/00*** | (2006.01) |
| ***B65D 5/38*** | (2006.01) |
| ***B65D 5/4805*** | (2006.01) |
| ***B65D 5/50*** | (2006.01) |

(52) U.S. Cl.

CPC ..... *B65D 85/30* (2013.01); *B65D 5/38* (2013.01); *B65D 5/48022* (2013.01); *B65D 5/50* (2013.01); *B65D 59/04* (2013.01); *B65D 73/0078* (2013.01)

(58) Field of Classification Search

CPC .... B65D 85/30; B65D 59/04; B65D 73/0078; B65D 5/48028; B65D 5/48034; B65D 5/5038; B65D 5/503; B65D 81/24; H05K 9/0067

USPC ..... 206/320, 576, 701, 721–725, 591–594; 229/125.125, 120.24, 120.32

See application file for complete search history.

(56) References Cited

U.S. PATENT DOCUMENTS

| | | | | |
|---|---|---|---|---|
| 2,464,951 A * | 3/1949 | Stengren | B65D 5/5007 | 206/45.29 |
| 4,438,848 A * | 3/1984 | Montealegre | B65D 5/5021 | 206/476 |
| 5,226,532 A * | 7/1993 | Davidson | B42D 15/045 | 206/232 |
| 5,803,267 A * | 9/1998 | Tu | B65D 5/22 | 206/576 |
| 5,899,336 A * | 5/1999 | Kataoka | B65D 5/5004 | 206/320 |
| 6,095,408 A * | 8/2000 | Nguyen | B65D 5/2009 | 229/120.21 |
| 6,769,543 B2 * | 8/2004 | Hsu | B65D 5/5038 | 206/486 |
| 6,997,323 B2 * | 2/2006 | Maresh | B65D 5/5069 | 206/486 |

(Continued)

*Primary Examiner* — Jacob K Ackun
*Assistant Examiner* — Jenine Pagan
(74) *Attorney, Agent, or Firm* — Steven Reiss

(57) ABSTRACT

A packaging box includes a connecting plate having a first side and a second side opposite the first side, a first case defining a first receiving cavity, and a second case defining a second receiving cavity and a third receiving cavity. The first case and the second case are foldably connected, respectively, to the first side and the second side of the connecting plate. The connecting plate is positioned between the first case and the second case.

14 Claims, 6 Drawing Sheets

(56) References Cited

U.S. PATENT DOCUMENTS

| | | | | |
|---|---|---|---|---|
| 7,549,537 | B2 * | 6/2009 | Hsu | B65D 5/5038 206/486 |
| 8,627,958 | B2 * | 1/2014 | McDonald | B65D 5/22 206/583 |
| 2012/0061272 | A1 * | 3/2012 | Wagner | B65D 5/4204 206/320 |
| 2014/0360913 | A1 * | 12/2014 | McDonald | B65D 5/22 206/583 |

* cited by examiner

PACKAGING BOX FOR ELECTRONIC DEVICE

FIELD

The subject matter herein generally relates to packaging boxes, and particularly to a packaging box for electronic devices.

BACKGROUND

To prevent fragile precision electronic devices, such as mobile phones, from being damaged during transportation, the electronic devices are packaged in boxes before shipment. The boxes must accommodate the electronic device and corresponding accessories.

BRIEF DESCRIPTION OF THE DRAWINGS

Many aspects of the present disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
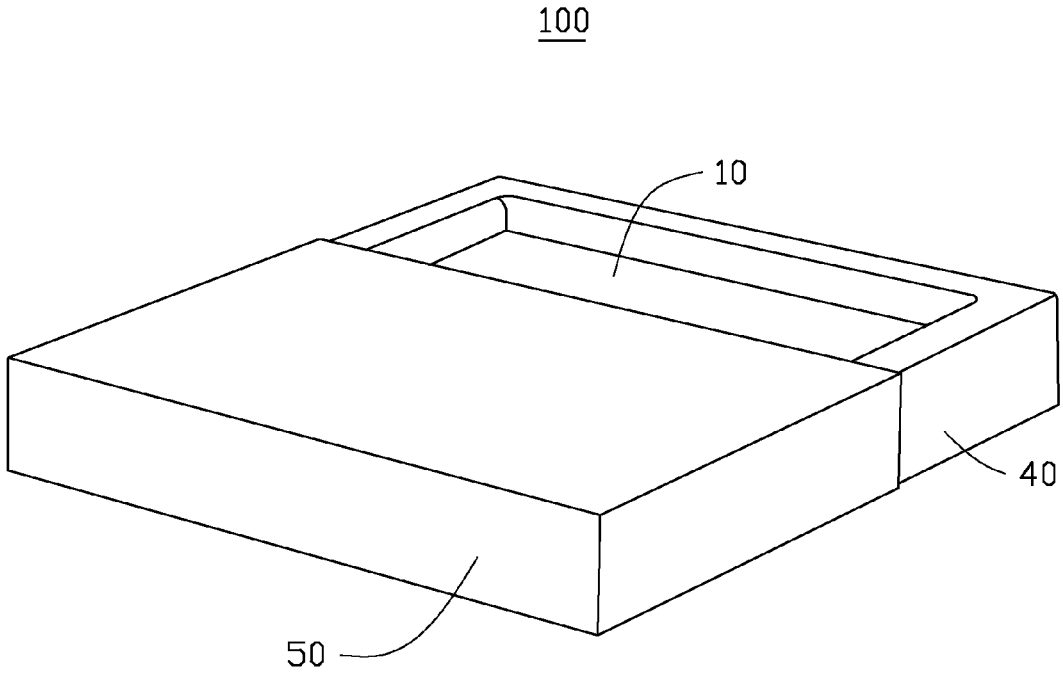
FIG. 1 is an isometric view of one embodiment of a packaging box.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "outside" refers to a region that is beyond the outermost confines of a physical object. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 3:
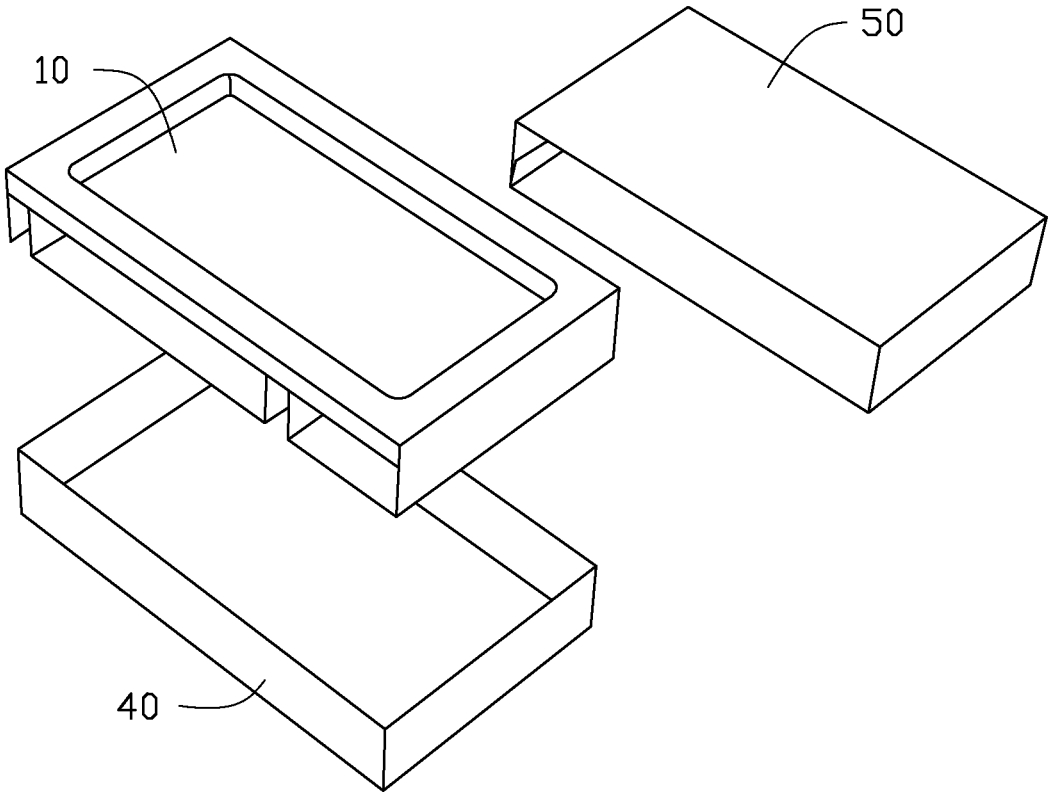
FIG. 3 is an exposed view of the packaging box of FIG. 1.

FIG. 1 is a diagrammatic view of a packaging box 100, according to an exemplary embodiment of the disclosure. The packaging box 100 is used to accommodate an electronic device and accessories (e.g. an earphone, a charger, a data cable, and a manual). The packaging box 100 includes a first case 10, a connecting plate 20 (shown in FIG. 5), a second case 30 (shown in FIG. 5), a box 40 (shown in FIG. 3) and a sleeve 50. The first and second cases 10, 30 are foldable and connected to the connecting plate 20 and arranged at two opposite sides of the connecting plate 20. The first and second cases 10, 30 are configured for receiving the electronic device and the accessories. The box 40 is configured for receiving and shaping the first case 10, the connecting plate 20, and the second case 30. The sleeve 50 is configured for receiving the box 40.

Figure 2:
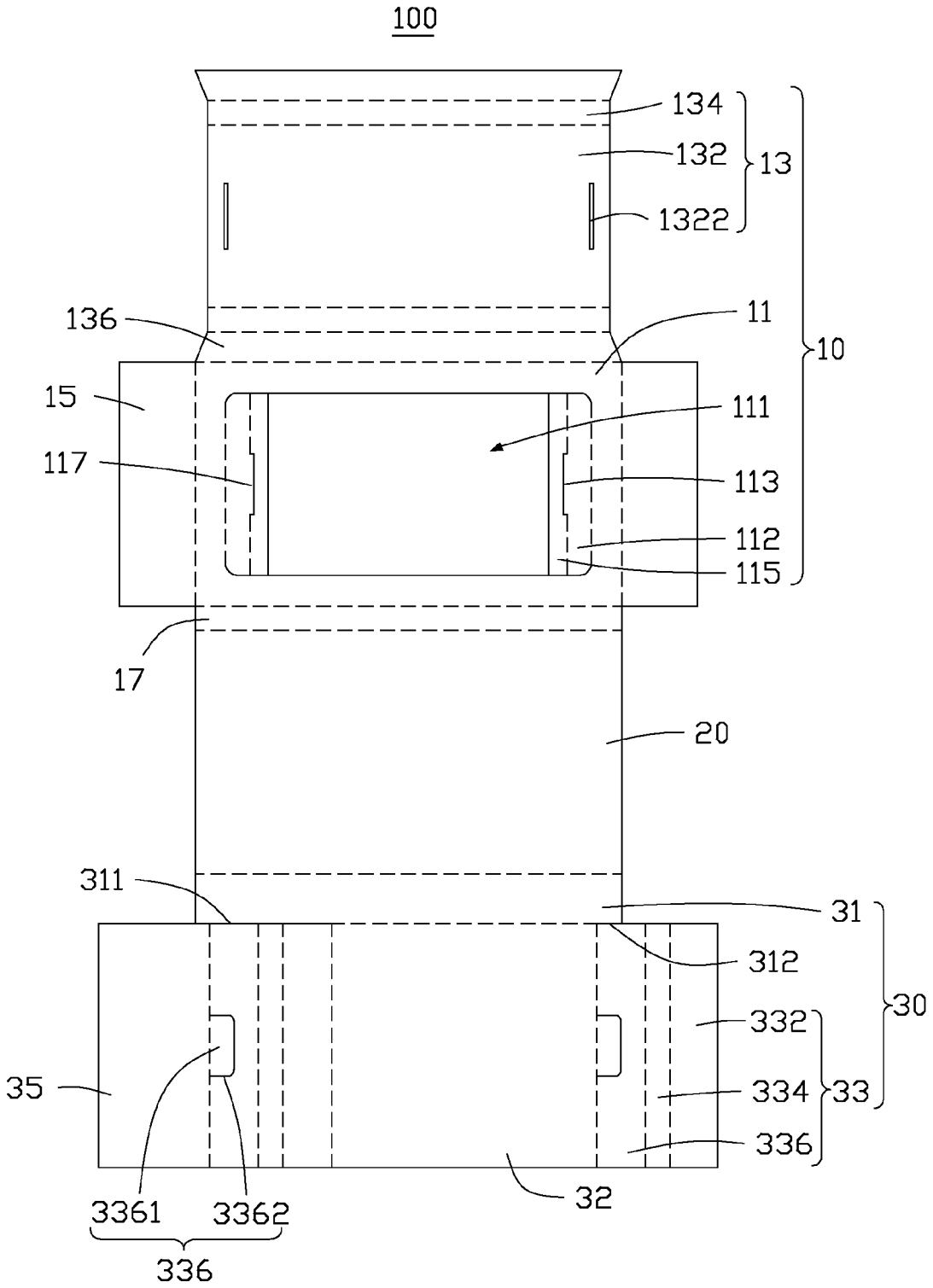
FIG. 2 is an isometric view of the packaging box of FIG. 1 in an unfolded configuration.

The first case 10, the connecting plate 20, and the second case 30 are made of a flat plate. The flat plate may be a paper plate, a plastic plate or the like or made of transparent material. FIG. 2 illustrates that the first case 10 includes a top plate 11, a bottom portion 13, two outer side plates 15 and a supporting plate 17.

A substantial rectangular through hole 111 is defined in a middle portion of the top plate 11. Two first inner side plates 112 are foldable and extended from two opposite ends of the through hole 111. A resisting plate 115 is foldable and extended from one side of each first inner side plate 112 opposite to the first inner side plate 112. A first perforated line 113 is defined between each first inner side plate 112 and the corresponding resisting plate 115. In this exemplary embodiment, the first perforated line 113 is substantially U-shaped.

The bottom portion 13 includes a bottom plate 132, two second inner side plates 134, and two adhering plates 136. Two latching holes 1322 are defined at two ends of the bottom plate 132 corresponding to the first perforated lines 13. The second inner side plates 134 are foldable and extended from two sides of the bottom plate 132. Each adhering plates 136 is foldable and extended from one side of one of second inner side plates 134. One of the adhering plates 136 is foldable and connected to one side of the top plate 11.

The two outer side plates 15 are foldable and connected to two ends of the top plate 11 adjacent to the adhering plates 136. One side of the supporting plate 17 is foldable and connected to another side of the top plate 11 opposite to the one of the adhering plates 136. Another side of the supporting plate 17 is foldable and connected to one side of the connecting plate 20.

Figure 4:
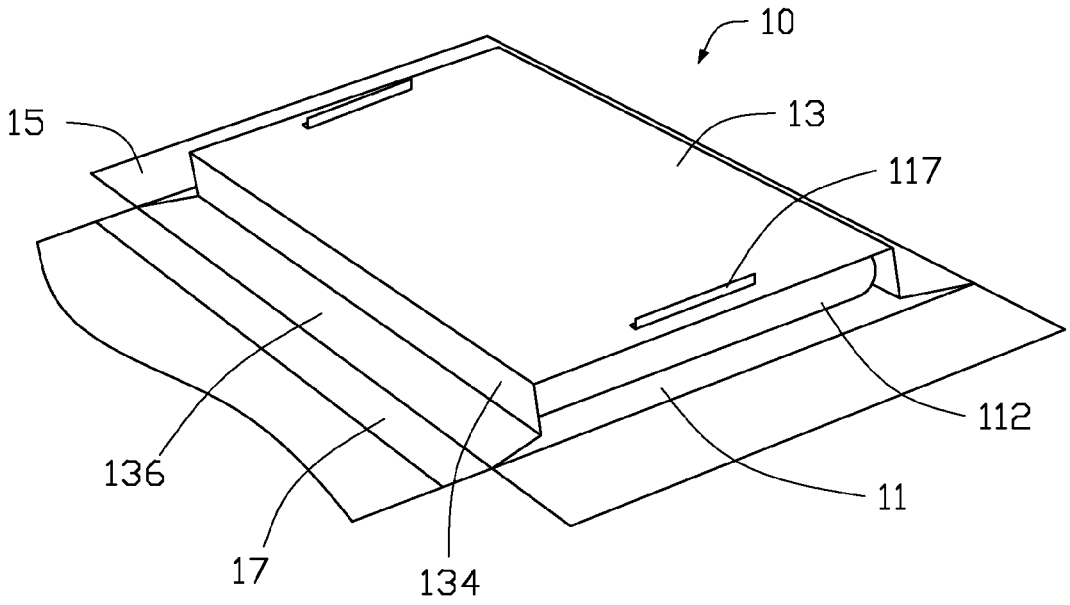
FIG. 4 is an isometric view of the packaging box of FIG. 1 in a folded configuration.

FIG. 4 illustrates that to form the first case 10, each first inner side plate 112 is perpendicularly folded relative to the top plate 11 and each resisting plate 115 is perpendicularly folded relative to the first inner side plate 112 so that a latching plate 117 protruding from each resisting plate 115 along the perforated line 13 is formed and corresponding to the latching holes 1322. The bottom plate 132 is folded to position below the through hole 111. The adhering plates 136 are adhered to two sides of the top plate 11 with the second inner side plates 134 perpendicularly abutting the top plate 11. Each latching plate 117 engages with the corresponding latching hole 1322. The resisting plates 115 resist against the bottom plate 13. The second inner side plates 134, the bottom plate 13, and the first inner side plates 112 cooperatively define a first receiving cavity 14 configured for receiving the electronic device. The two outer side plates 15 are perpendicularly folded relative to the top plate 11. The supporting plate 17 is perpendicular folded relative to the top plate 11.

The second case 30 includes a first sidewall 31, a first bottom wall 32, two second sidewalls 33, and a second bottom wall 35. One side of the first sidewall 31 is foldable and connected to the connecting plate 20. Another side of the first sidewall 31 is foldable and connected to the first bottom wall 32. The two second sidewalls 33 are foldable and connected to two opposite edges of the first bottom wall 32 respectively adjacent to the first sidewall 31. A second perforated line 311 and a third perforated line 312 are defined between each second sidewall 33 and the first bottom wall 32. A length of the second perforated line 311 is slightly longer than that of the third perforated line 312.

Each second sidewall 33 includes a first section 332, a connecting section 334, and a second section 336 foldable and orderly connected together. The second section 336 of one of the second sidewalls 33 and the first section 332 of another second sidewall 33 are foldable and connected to the first bottom wall 32. The second section 336 of another second sidewall 33 is foldable and connected to the second bottom wall 35. An edge of each second section 336 defines a fourth perforated line 3361. In this exemplary embodiment, each fourth perforated line 3361 is substantially U-shaped. One fourth perforated line 3361 is positioned between one of the second sections 336 and the first bottom wall 32, and another fourth perforated line 3361 is positioned between another second section 336 and the second bottom wall 35.

Figure 5:
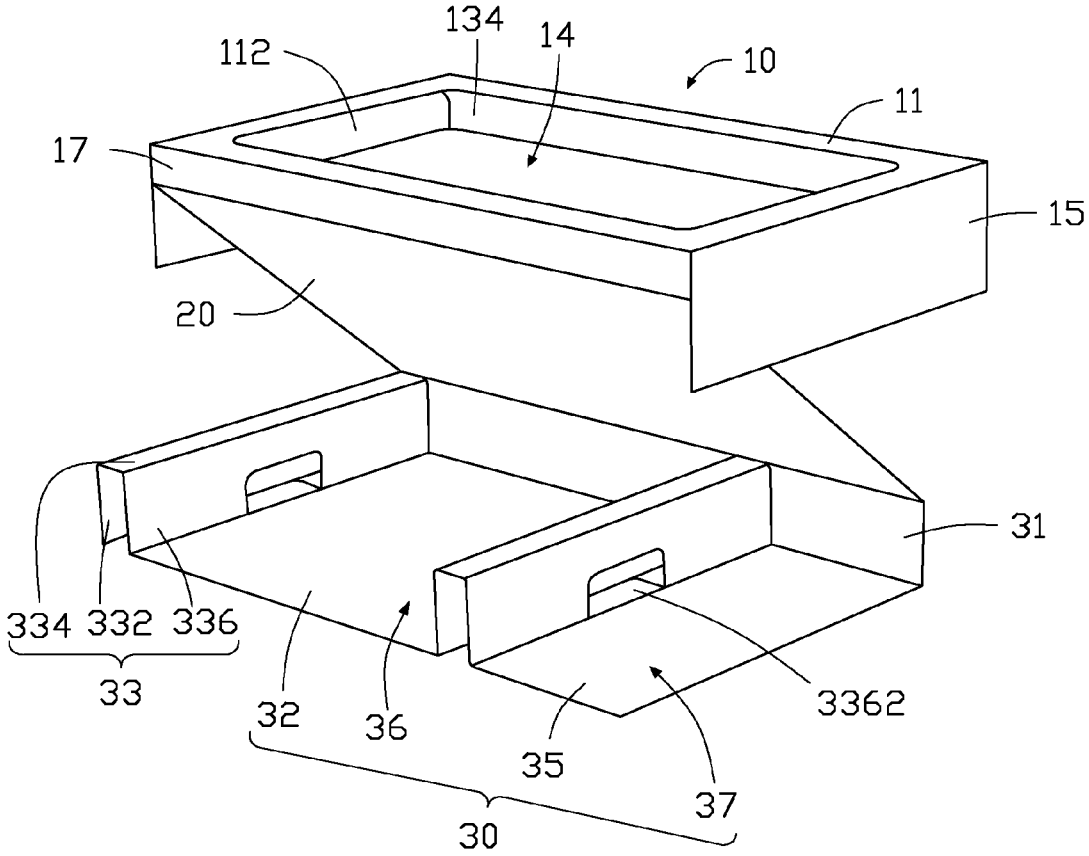
FIG. 5 is an isometric view of the packaging box of FIG. 1 in a partially folded configuration.

FIG. 5 illustrates that to form the second case 30, the first sidewall 31 is perpendicularly folded relative to the first bottom wall 32. The second section 336 of the second sidewall 33 adjacent to the second perforated line 311 is perpendicularly folded relative to the connecting section 334 and a supporting tip 3361 protruding from the second bottom wall 35 along one of the fourth perforated lines 3361 is formed, the connecting section 332 is perpendicularly folded relative to the second section 332, and the first section 332 is perpendicularly folded relative to the connecting plate 334 and supported by the supporting tip 3361. The second section 336 of the second sidewall 33 adjacent to the third perforated line 312, is perpendicularly folded relative to the first bottom wall 32 and another supporting tip 3361 protruding from the first bottom wall 32 along another of the fourth perforated lines 3361 is formed, the connecting section 332 is perpendicularly folded relative to the second section 334, and the first section 332 is perpendicularly folded relative to the connecting section 334. Therefore, the second sidewalls 33, the first bottom wall 32, and one portion of the first sidewall 31 cooperatively define a second receiving cavity 36, and one of the second sidewalls 33 adjacent to the second perforated line 311, the second bottom wall 35 and another portion of the first sidewall 31 cooperatively define a third receiving cavity 37.

The box 40 is a box having a first opening at one side of the box. The folded first and second cases 10, 20 and the connecting plate 20 are received in the box 40 or can be formed by the box 40. The sleeve 50 is configured for packaging the housing 10. The sleeve 50 is substantially a hollow box having a second opening at an end of the box. The housing 10 can be slid into the sleeve 50 via the second opening.

Figure 6:
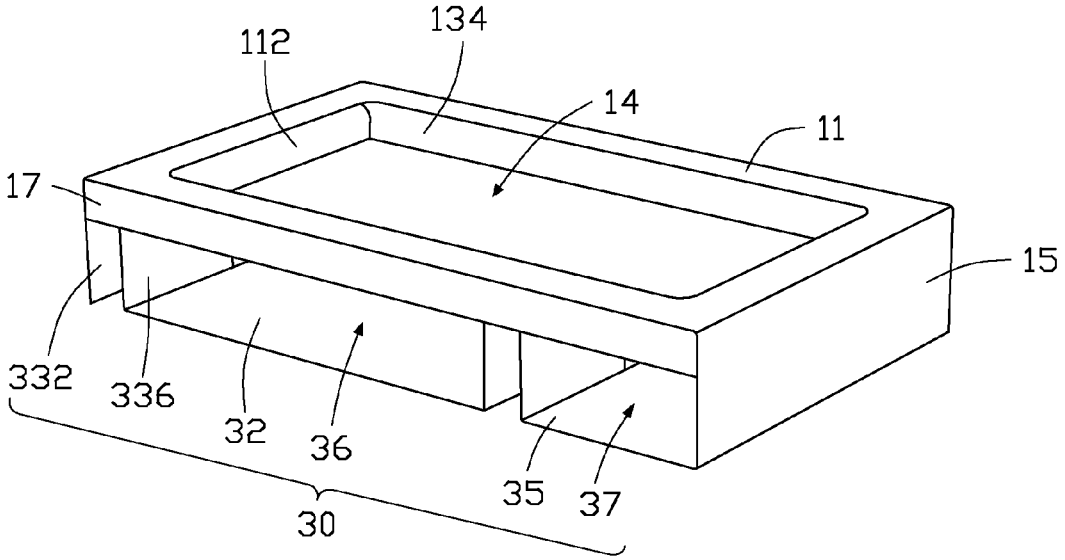
FIG. 6 is similar to FIG. 4, but showing the packaging box of FIG. 4 from another angle.

FIG. 6 illustrates that to package the electronic device and the accessories in the packaging box 100, the folded first and second case 10, 30 are folded to be arranged at two opposite sides of the connecting plate 20. The outer side plates 15 abut two ends of the second cases 30. A height of each outer side plate 15 may be equal to a sum of the heights of the second case 30 and the supporting plate 17. The electronic device is received in the first receiving cavity 14 and the accessories are received in the second and third receiving cavities 36, 37. The folded first and second case 10, 30 and the connecting plate 20 are placed into the box 40 with the electronic device and the accessories. The sleeve 50 is sleeved outside the box 40. Therefore, the electronic device and the accessories are packaged by the packaging box 100.

The packaging box 100 defines a plurality of the receiving cavities for accommodating the electronic device and the accessories by the first and second cases 10, 30 which has a relative simple structure. In addition, the electronic device and the accessories can be protected by the packaging box 100.

It is to be understood, however, that even through numerous characteristics and advantages of the present disclosure have been set forth in the foregoing description, together with details of assembly and function, the disclosure is illustrative only, and changes may be made in the details, especially in the matters of shape, size, and arrangement of parts within the principles of the disclosure to the full extent indicated by the broad general meaning of the terms in which the appended claims are expressed.

What is claimed is:

1. A packaging box comprising:

a connecting plate having a first side and a second side opposite the first side;

a first case defining a first receiving cavity, wherein the first case comprises a top plate defining a through hole and a bottom portion foldably connected to the top plate, the top plate comprises two first inner side plates foldably extended from two opposite ends of the through hole; each first inner side plate is perpendicularly folded relative to the top plate;

wherein the bottom portion comprises a bottom plate, two second inner side plates foldably extended from two sides of the bottom plate, and two adhering plates foldably extended from the second inner side plates, the bottom plate is folded to position below the through hole, the adhering plates are adhered to two sides of the top plate with the second inner side plates perpendicularly abutting on the top plate, the second inner side plates, the bottom plate, and the first inner side plates cooperatively define the first receiving cavity; and a second case defining a second receiving cavity and a third receiving cavity, wherein the first case and the second case are foldably connected, respectively, to the first side and the second side of the connecting plate, the connecting plate is positioned between the first case and the second case.

2. The packaging box of claim 1, wherein the first case, the connecting plate, and the second case are made of a flat plate.

3. The packaging box of claim 2, further comprising a sleeve sleeved outside the box.

4. The packaging box of claim 1, wherein the top plate further comprises two resisting plate foldably extended from one side of each first inner side plate opposite to the first inner side plate, each resisting plate is perpendicularly folded relative to the first inner side plate and resists against the bottom portion.

5. The packaging box of claim 4, wherein the top plate further defines a first perforated line between each first inner side plate and the corresponding resisting plate, the top plate further comprises a latching plate protruding from each resisting plate along the first perforated line, the bottom plate further defines two latching holes corresponding to the latching plates, the latching plates engage with the latching holes.

6. The packaging box of claim 1, wherein the second case comprises a first sidewall, a first bottom wall, two second sidewalls, and a second bottom wall, one side of the first sidewall is foldably connected to the connecting plate, and another side of the first sidewall is foldably connected to the first bottom wall, the two second sidewalls are foldably connected to two opposite edges of the first bottom wall adjacent to the first sidewall, respectively, the second bottom wall is foldably connected to one of the second sidewall; the second sidewalls, the first bottom wall, and one portion of the first sidewall cooperatively define the second receiving cavity, and one of the second sidewalls, the second bottom wall and another portion of the first sidewall cooperatively define the third receiving cavity.

7. The packaging box of claim 6, wherein each second sidewall comprises a first section, a connecting section, and a second section foldably and orderly connected together, the second section of one of the second sidewalls and the first section of another second sidewall are foldably connected to the first bottom wall, the second section of another second sidewall is foldably connected to the second bottom wall.

8. The packaging box of claim 7, wherein an edge of each second section further defines a second perforated line, the second case further comprises two supporting tips protruding from the first and second bottom wall and supporting the first sections.

9. A packaging box comprising:

a connecting plate;

a first case, the first case comprising a top plate defining a through hole and a bottom portion foldably connected to the top plate, the top plate comprises two first inner side plates perpendicularly connected to two opposite ends of the through hole, the first inner plates and the bottom portion cooperatively defining a first receiving cavity, wherein the bottom portion comprise a bottom plate, two second inner side plates foldably extended from two sides of the bottom plate, and two adhering plates foldably extended from the second inner side plates, the bottom plate is folded to position below the through hole, the adhering plates are adhered to two sides of the top plate with the second inner side plates perpendicularly abutting on the top plate, the second inner side plates, the bottom plate, and the first inner side plates cooperatively define the first receiving cavity;

a second case defining a second and third receiving cavities; wherein the first case and the second case are foldably connected to two opposite sides of the connecting plate and the connecting plate is sandwiched between the first case and the second case.

10. The packaging box of claim 9, wherein the top plate further comprises two resisting plate foldably extended from one side of each first inner side plate opposite to the first inner side plate, each resisting plate is perpendicularly folded relative to the first inner side plate and resists against the bottom portion.

11. The packaging box of claim 10, wherein the top plate further defines a first perforated line between each first inner side plate and the corresponding resisting plate, the top plate further comprises a latching plate protruding from each resisting plate along the first perforated line, the bottom plate further defines two latching holes corresponding to the latching plates, the latching plates engage with the latching holes.

12. The packaging box of claim 9, wherein the second case comprises a first sidewall, a first bottom wall, two second sidewalls, and a second bottom wall, one side of the first sidewall is foldably connected to the connecting plate, and another side of the first sidewall is foldably connected to the first bottom wall, the two second sidewalls are foldably connected to two opposite edges of the first bottom wall adjacent to the first sidewall, respectively, the second bottom wall is foldably connected to one of the second sidewall; the second sidewalls, the first bottom wall, and one portion of the first sidewall cooperatively define the second receiving cavity, and one of the second sidewalls, the second bottom wall and another portion of the first sidewall cooperatively define the third receiving cavity.

13. The packaging box of claim 12, wherein each second sidewall comprises a first section, a connecting section, and a second section foldably and orderly connected together, the second section of one of the second sidewalls and the first section of another second sidewall are foldably connected to the first bottom wall, the second section of another second sidewall is foldably connected to the second bottom wall.

14. The packaging box of claim 13, wherein an edge of each second section further defines a second perforated line, the second case further comprises two supporting tips protruding from the first and second bottom wall and supporting the first sections.

* * * * *